US006715991B2

(12) United States Patent
Rossi et al.

(10) Patent No.: US 6,715,991 B2
(45) Date of Patent: Apr. 6, 2004

(54) ROTOR BLADE FOR CENTRIFUGAL COMPRESSOR WITH A MEDIUM FLOW COEFFICIENT

(75) Inventors: Eugenio Rossi, Viareggio (IT); Gianluca Rocchi, Florence (IT)

(73) Assignee: Nuovo Pignone Holdings S.p.A., Florence (IT)

( * ) Notice: Subject to any disclaimer, the term of this patent is extended or adjusted under 35 U.S.C. 154(b) by 0 days.

(21) Appl. No.: 10/290,256

(22) Filed: Nov. 8, 2002

(65) Prior Publication Data

US 2003/0091438 A1 May 15, 2003

(30) Foreign Application Priority Data

Nov. 15, 2001 (IT) ..... MI2001A2413

(51) Int. Cl.[7] ..... F01D 5/14
(52) U.S. Cl. ..... 416/223 R; 416/185
(58) Field of Search ..... 416/223 R, 185, 416/186 R, 223 B, 182, 183, 175, 203

(56) References Cited

U.S. PATENT DOCUMENTS 4,666,373 A * 5/1987 Sugiura ..... 416/185
5,832,606 A * 11/1998 Kushner ..... 29/889.7
6,340,291 B1 * 1/2002 Reckert ..... 416/185

* cited by examiner

*Primary Examiner*—Edward K. Look
*Assistant Examiner*—James M McAleenan
(74) *Attorney, Agent, or Firm*—Nixon & Vanderhye

(57) ABSTRACT

A cylindrical blade for a rotor of the purely radial type of a centrifugal compressor with a medium flow coefficient comprises a first surface (3) of the pressure side and a second surface (5) of the suction side of equal curvature, both having generatrices parallel to the axis (Z) of rotation of the rotor, in which the line (7) of curvature of the said surfaces (3, 5) is defined, in a Cartesian reference system, by the ratio between the coordinates of a discrete set of points (9) belonging to the line and the outer radius (R) of the rotor (10).

4 Claims, 3 Drawing Sheets

ROTOR BLADE FOR CENTRIFUGAL COMPRESSOR WITH A MEDIUM FLOW COEFFICIENT

The present invention relates to a rotor blade for a centrifugal compressor with a medium flow coefficient.

More precisely, the invention relates to a cylindrical blade for a centrifugal rotor of a multi-stage compressor.

In the field of centrifugal compressors, the flow coefficient is defined as $\Phi=(4*q)/(\pi*d^2*u")$ in which:

q is the volume flow rate;

d is the outer diameter of the rotor;

u" is the peripheral velocity of the rotor.

This dimensionless coefficient can be used to define the operating characteristic of the compressor, and can be used to classify the different types of compressor at the design stage.

Compressors are therefore made to handle different flow rates, in other words to operate with different values of the flow coefficient, according to the applications for which they are intended.

For example, we may mention compressors with a medium flow coefficient, in which has values in the vicinity of 0.04, and compressors with a medium-high flow coefficient, for which $\Phi$ is approximately 0.06.

However, one of the main requirements common to all compressors relates to the high aerodynamic efficiency which must be attained in most of the stages.

The geometric configuration of the rotor blading significantly affects the aerodynamic efficiency, due to the fact that the geometric characteristics of the blade determine the distribution of the relative velocities of the fluid along the rotor, thus affecting the distribution of the boundary layers along the walls and, in the final analysis, the friction losses.

The aerodynamic efficiency is particularly critical for rotors made with stages having two-dimensional blades, in other words purely radial rotors in which the blades are flat or cylindrical with generatrices parallel to the axis of rotation of the rotor.

Conventionally, for reasons of economy in manufacture, the blades used in this type of rotor have a relatively simple geometry in which the median line of the section consists of an arc of a circumference and the thickness is constant along the blade, except in the region of the leading edge, which is formed by a semicircular fillet or, in particular cases, by a tapering of the thickness.

Although two-dimensional blades are made by relatively simple machining processes and are therefore very widely used, their geometry does not enable a high aerodynamic efficiency of the rotor to be achieved.

A first object of the present invention is therefore to provide a blade which, by means of a suitable configuration, enables a high aerodynamic efficiency to be achieved.

Another object of the present invention is to provide a blade which can be manufactured economically on a large scale by automated processes.

These and other objects of the present invention are achieved with the rotor blade for a centrifugal compressor with a medium flow coefficient according to the content of claim 1.

Further characteristics of the blade according to the invention are described in the subsequent claims.

The characteristics and advantages of the rotor blade for a centrifugal compressor according to the present invention will be made clearer by the following description, which is provided by way of example and without restrictive intent, and which refers to the attached drawings, in which.

Figure 1:
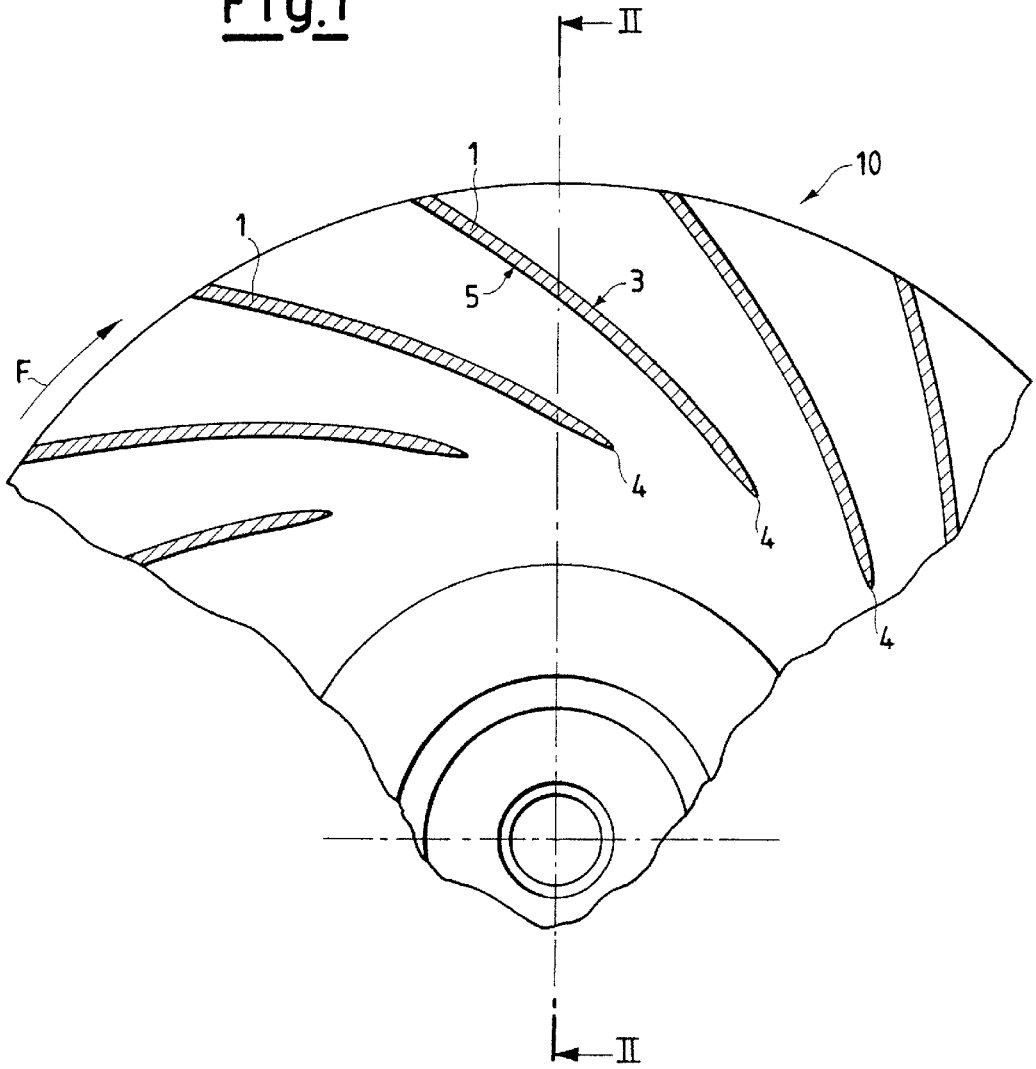
FIG. 1 is a front view, in partial section, of a rotor having blades according to the invention.
Figure 2:
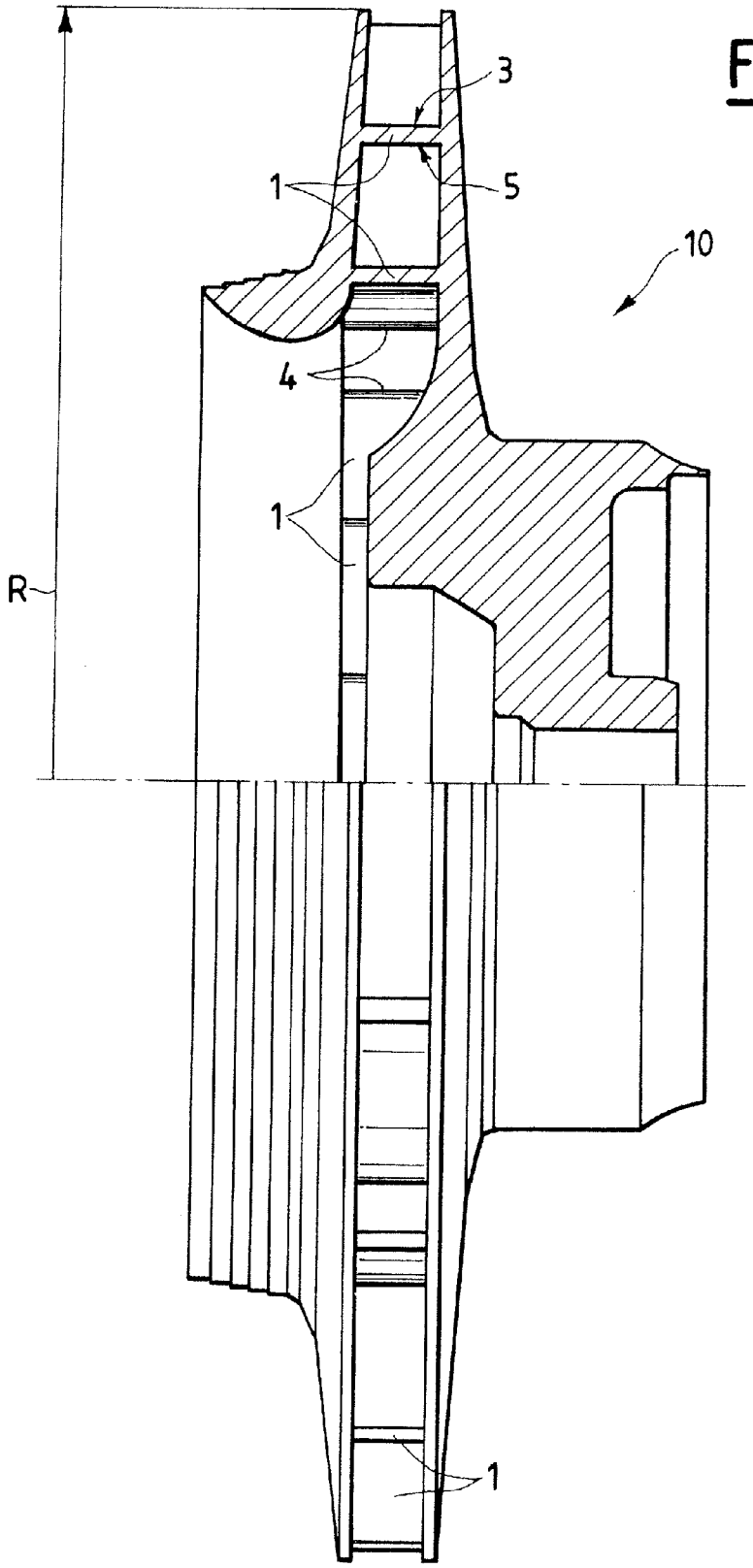
FIG. 2 is a view, in partial section, of the rotor, taken through the line II—II in FIG. 1.

With reference to FIGS. 1 and 2, a rotor 10 of the purely radial type with an outer radius R belonging to a centrifugal compressor with a medium flow coefficient comprises a plurality of cylindrical blades 1.

Each blade 1 comprises a first surface 3 of the pressure side facing forwards with respect to the direction of rotation of the rotor, indicated by the arrow F, and a second surface 5 of the suction side, opposite the first surface.

The surfaces 3 and 5 are substantially cylindrical, have equal curvature, and are made with generatrices parallel to the axis Z of rotation of the rotor 10.

The two surfaces 3 and 5 are joined together at one end by a known method; for example, a tapering of the thicknesses, or alternatively a semicircular fillet (not illustrated) is provided at the leading edge 4.

Figure 3:
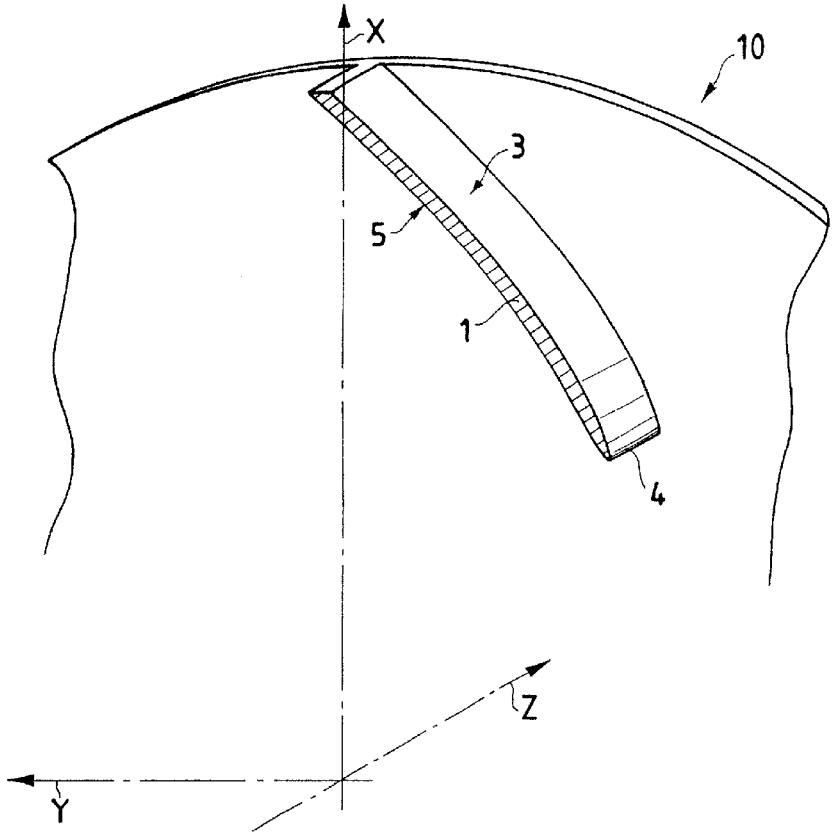
FIG. 3 is a schematic axonometric view of a blade according to the invention.
Figure 4:
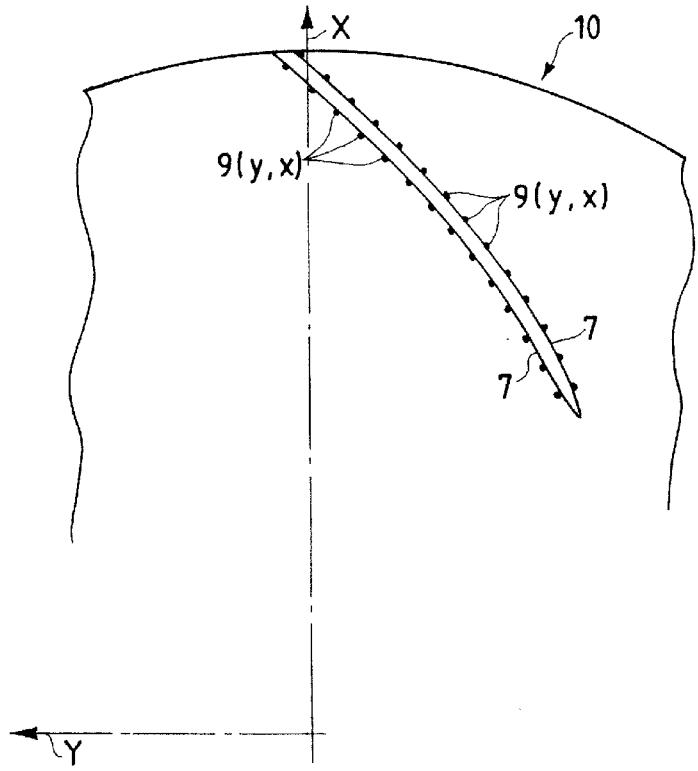
FIG. 4 shows the profile of the blade of FIG. 3 at the position of its geometric intersection with the hub of the rotor.

With reference to FIGS. 3 and 4, the projection of each of the said surfaces 3 and 5 on a plane Y, X of a right-handed Cartesian system Y, X, Z, having an axis of ordinates X, an axis of abscissae Y, and an axis Z coinciding with the axis of rotation of the rotor 10, is a curved line 7 defined by a discrete set of points 9 belonging to the said curve 7, whose coordinates y, on the axis of abscissae, and x, on the axis of ordinates, are conveniently expressed as a function of the outer radius R of the rotor.

As a result of this definition of the curve 7, the surfaces 3 and 5, and substantially the blade 1, can be conveniently formed by means of automatic machines, for example those of the numerically controlled type, or the like.

According to the operating conditions for which they are intended, the rotor 10 and correspondingly the blades 1 can also be made in various sizes.

According to the known law of similarity, the characteristics of a rotor are in fact, within certain limits, substantially dependent on the curvature of the blades, and are therefore, as a first approximation, equal for similar rotors.

By applying the law of similarity, it is possible to disregard the absolute dimensions of the blade and define its geometry, for example by means of the ratios x/R and y/R of the coordinates of the points 9 to the value of the outer radius R of the rotor.

It has also been found that the efficiency varies only slightly with the variation of the curvatures of the surfaces 3 and 5, and therefore of the curve 7 when this is kept within a range of variation of the coordinates y, x of the points 9 equal to ±0.600 mm.

The curve 7 of the blade 1 according to the invention, expressed as a function of the outer radius R of the rotor, in the form, respectively, of the ratios y/R and x/R between the values of the coordinates of each point and the value of the said radius R, is defined by the following values:

x/R=0.450; y/R=−0.397
x/R=0.455; y/R=−0.391
x/R=0.461; y/R=−0.387
x/R=0.468; y/R=−0.384
x/R=0.474; y/R=−0.381
x/R=0.480; y/R=−0.377
x/R=0.486; y/R=−0.374
x/R=0.493; y/R=−0.371 x/R=0.499; y/R=−0.368
x/R=0.505; y/R=−0.365
x/R=0.512; y/R=−0.362
x/R=0.518; y/R=−0.359
x/R=0.524; y/R=−0.356
x/R=0.531; y/R=−0.353
x/R=0.537; y/R=−0.350
x/R=0.543; y/R=−0.347
x/R=0.550; y/R=−0.344
x/R=0.556; y/R=−0.341
x/R=0.562; y/R=−0.337
x/R=0.568; y/R=−0.334
x/R=0.575; y/R=−0.331
x/R=0.581; y/R=−0.328
x/R=0.587; y/R=−0.321
x/R=0.593; y/R=−0.321
x/R=0.599; y/R=−0.318
x/R=0.605; y/R=−0.314
x/R=0.612; y/R=−0.311
x/R=0.618; y/R=−0.307
x/R=0.624; y/R=−0.303
x/R=0.630; y/R=−0.300
x/R=0.650; y/R=−0.287
x/R=0.670; y/R=−0.275
x/R=0.690; y/R=−0.261
x/R=0.709; y/R=−0.248
x/R=0.729; y/R=−0.234
x/R=0.748; y/R=−0.220
x/R=0.767; y/R=−0.205
x/R=0.785; y/R=−0.190
x/R=0.804; y/R=−0.175
x/R=0.822; y/R=−0.160
x/R=0.844; y/R=−0.140
x/R=0.866; y/R=−0.120
x/R=0.888; y/R=−0.100
x/R=0.910; y/R=−0.079
x/R=0.931; y/R=−0.058
x/R=0.952; y/R=−0.037
x/R=0.972; y/R=−0.015
x/R=0.993; y/R=0.007.

Example of Embodiment

A rotor 10 was made with an outer radius of 200 mm and with 17 cylindrical blades 1 having surfaces 3 of the pressure sides and surfaces 5 of the suction sides with equal curvature, defined by the following coordinates y, x of a discrete set of points 9 of the curve 7 of the intersection of one of the surfaces 3 and 5 with the plane Y, X of a right-hand system of Cartesian axes Y, X, Z where Y is the axis of abscissae and X is the axis of ordinates:

x=89.957; y=−79.420;
x=91.036; y=−78.247;
x=92.261; y=−77.492;
x=93.504; y=−76.790;
x=94.753; y=−76.115;
x=96.007; y=−75.462;
x=97.264; y=−74.820;
x=98.524; y=−74.190;
x=99.788; y=−73.573;
x=101.064; y=−72.962;
x=102.321; y=−72.354;
x=103.592; y=−71.758;
x=104.867; y=−71.171;
x=106.139; y=−70.576;
x=107.407; y=−69.973;
x=108.673; y=−69.363;
x=109.934; y=−68.745;
x=111.191; y=−68.119;
x=112.449; y=−67.483;
x=113.692; y=−66.840;
x=114.937; y=−66.188;
x=116.177; y=−65.529;
x=117.414; y=−64.261;
x=118.646; y=−64.185;
x=119.874; y=−63.502;
x=121.098; y=−62.811;
x=122.317; y=−62.112;
x=123.533; y=−61.406;
x=124.744; y=−60.693;
x=125.951; y=−59.972;
x=130.003; y=−57.480;
x=134.008; y=−54.910;
x=137.965; y=−52.265;
x=141.875; y=−49.548;
x=145.737; y=−46.763;
x=149.553; y=−43.913;
x=153.323; y=−41.000;
x=157.048; y=−38.028;
x=160.728; y=−35.000;
x=164.365; y=−31.918;
x=168.848; y=−27.992;
x=173.262; y=−23.989;
x=177.613; y=−19.912;
x=181.903; y=−15.768;
x=186.137; y=−11.563;
x=190.317; y=−7.303;
x=194.448; y=−2.994;
x=198.537; y=1.364.

When this rotor was subjected to fluid-dynamic testing, its polytropic stage efficiency was found to be considerably higher than that of prior art rotors.

What is claimed is:

1. Cylindrical blade for a rotor of the purely radial type of a centrifugal compressor with a medium flow coefficient, the said blade (1) comprising a first surface (3) of the pressure side and a second surface (5) of the suction side having equal curvature, both having generatrices parallel to the axis (Z) of rotation of the rotor, characterized in that the intersection of each of the said surfaces (3, 5) on a plane (Y, X) of a righthand Cartesian reference system (Y, X, Z), having an axis of ordinates (X) and an axis of abscissae (Y), and an axis (Z) coinciding with the axis of rotation of the rotor, is a curved line (7) defined by a discrete set of points belonging to the said curve (7) whose coordinates (y) on the axis of abscissae and (x) on the axis of ordinates are expressed as a function of the outer radius (R) of the rotor as the ratios y/R and x/R respectively between the values of the coordinate of each point and the value of the said radius (R) of the rotor, the coordinates (y, x) of the said points being variable within a range of ±0.600 mm on both the abscissa and the ordinate:

x/R=0.450; y/R=−0.397
x/R=0.455; y/R=−0.391
x/R=0.461; y/R=−0.387
x/R=0.468; y/R=−0.384
x/R=0.474; y/R=−0.381
x/R=0.480; y/R=−0.377
x/R=0.486; y/R=−0.374
x/R=0.493; y/R=−0.371
x/R=0.499; y/R=−0.368
x/R=0.505; y/R=−0.365
x/R=0.512; y/R=−0.362
x/R=0.518; y/R=−0.359 x/R=0.524; y/R=−0.356
x/R=0.531; y/R=−0.353
x/R=0.537; y/R=−0.350
x/R=0.543; y/R=−0.347
x/R=0.550; y/R=−0.344
x/R=0.556; y/R=−0.341
x/R=0.562; y/R=−0.337
x/R=0.568; y/R=−0.334
x/R=0.575; y/R=−0.331
x/R=0.581; y/R=−0.328
x/R=0.587; y/R=−0.321
x/R=0.593; y/R=−0.321
x/R=0.599; y/R=−0.318
x/R=0.605; y/R=−0.314
x/R=0.612; y/R=−0.311
x/R=0.618; y/R=−0.307
x/R=0.624; y/R=−0.303
x/R=0.630; y/R=−0.300
x/R=0.650; y/R=−0.287
x/R=0.670; y/R=−0.275
x/R=0.690; y/R=−0.261
x/R=0.709; y/R=−0.248
x/R=0.729; y/R=−0.234
x/R=0.748; y/R=−0.220
x/R=0.767; y/R=−0.205
x/R=0.785; y/R=−0.190
x/R=0.804; y/R=−0.175
x/R=0.822; y/R=−0.160
x/R=0.844; y/R=−0.140
x/R=0.866; y/R=−0.120
x/R=0.888; y/R=−0.100
x/R=0.910; y/R=−0.079
x/R=0.931; y/R=−0.058
x/R=0.952; y/R=−0.037
x/R=0.972; y/R=−0.015
x/R=0.993; y/R=0.007.

2. Cylindrical blade according to claim 1, in which the said curved line (7) is defined by the following coordinates (y, x) of a discrete set of points belonging to the said curve (7) and in which the said rotor has an outer radius (R) of 200 mm:

x=89.957; y=−79.420;
x=91.036; y=−78.247;
x=92.261; y=−77.492;
x=93.504; y=−76.790;
x=94.753; y=−76.115;
x=96.007; y=−75.462;
x=97.264; y=−74.820;
x=98.524; y=−74.190;
x=99.788; y=−73.573;
x=101.064; y=−72.962;
x=102.321; y=−72.354;
x=103.592; y=−71.758;
x=104.867; y=−71.171;
x=106.139; y=−70.576;
x=107.407; y=−69.973;
x=108.673; y=−69.363;
x=109.934; y=−68.745;
x=111.191; y=−68.119;
x=112.449; y=−67.483;
x=113.692; y=−66.840;
x=114.937; y=−66.188;
x=116.177; y=−65.529;
x=117.414; y=−64.261;
x=118.646; y=−64.185;
x=119.874; y=−63.502;
x=121.098; y=−62.811;
x=122.317; y=−62.112;
x=123.533; y=−61.406;
x=124.744; y=−60.693;
x=125.951; y=−59.972;
x=130.003; y=−57.480;
x=134.008; y=−54.910;
x=137.965; y=−52.265;
x=141.875; y=−49.548;
x=145.737; y=−46.763;
x=149.553; y=−43.913;
x=153.323; y=−41.000;
x=157.048; y=−38.028;
x=160.728; y=−35.000;
x=164.365; y=−31.918;
x=168.848; y=−27.992;
x=173.262; y=−23.989;
x=177.613; y=−19.912;
x=181.903; y=−15.768;
x=186.137; y=−11.563;
x=190.317; y=−7.303;
x=194.448; y=−2.994;
x=198.537; y=1.364.

3. Rotor of the purely radial type of a centrifugal compressor with a medium flow coefficient, characterized in that it incorporates a plurality of blades (1) according to any one of the preceding claim 1.

4. Rotor according to claim 3, characterized in that it has an outer radius of 200 mm and in that it incorporates 17 blades (1).

* * * * *

UNITED STATES PATENT AND TRADEMARK OFFICE

CERTIFICATE OF CORRECTION

PATENT NO. : 6,715,991 B1
DATED : April 6, 2004
INVENTOR(S) : Rossi et al.

It is certified that error appears in the above-identified patent and that said Letters Patent is hereby corrected as shown below:

Column 1,
Line 23, insert -- Φ -- between "in which" and "has"

Column 6,
Lines 52-53, delete "any one of the preceding".

Signed and Sealed this

First Day of June, 2004

JON W. DUDAS
*Acting Director of the United States Patent and Trademark Office*